United States Patent [19]

Colvin

[11] Patent Number: 4,787,275

[45] Date of Patent: Nov. 29, 1988

[54] ADJUSTABLE DOUBLE-ENDED BOX WRENCH

[76] Inventor: David S. Colvin, 23933 Haynes, Farmington Hills, Mich. 48018

[21] Appl. No.: 28,489

[22] Filed: Mar. 20, 1987

[51] Int. Cl.[4] ..... B25B 13/10

[52] U.S. Cl. ..... 81/77; 81/170; 81/155

[58] Field of Search ..... 81/77, 170, 176.1, 177.1, 81/129, 155, 167, 98, DIG. 2

[56] References Cited

U.S. PATENT DOCUMENTS

| | | | |
|---|---|---|---|
| 592,199 | 10/1897 | Fletcher . | |
| 907,001 | 12/1908 | Brinser | 81/77 |
| 1,215,726 | 2/1917 | Shew . | |
| 1,444,907 | 2/1923 | Fisher . | |
| 1,561,812 | 11/1925 | White . | |
| 1,585,825 | 5/1926 | Bessolo . | |
| 1,781,994 | 11/1930 | Wilson . | |
| 2,814,226 | 11/1957 | Lojczyc . | |
| 3,282,136 | 11/1966 | Maichen . | |
| 3,673,896 | 7/1972 | Vardaman . | |
| 4,065,986 | 1/1978 | Meggs et al. . | |
| 4,084,456 | 4/1978 | Pasbrig | 81/98 |
| 4,151,763 | 5/1979 | Colvin . | |
| 4,325,275 | 4/1982 | Colvin . | |

FOREIGN PATENT DOCUMENTS

| | | | |
|---|---|---|---|
| 0004277 | 2/1902 | United Kingdom | 81/77 |

*Primary Examiner*—Frederick R. Schmidt

*Assistant Examiner*—Lawrence Cruz

*Attorney, Agent, or Firm*—Brooks & Kushman

[57] ABSTRACT

An adjustable double-ended box wrench (10,10') is disclosed as including a wrench body (12) defining large and small box wrenches (20,22), an adjustable jaw assembly (14,14') including an elongated adjusting member (54,54') and a rotatable adjuster (56) that moves jaw end surfaces (70,72) to adjust the sizes of the wrenches, and a cover plate (16) that is secured to the wrench body (12) to retain the adjustable jaw assembly (14,14'). Each of the large and small box wrenches (20,22) includes a pair of associated diverging portions (34,44) and a pair of converging portions (36,46) as well as an associated connecting portion (42,52) that connect the associated engagement portions. Each of the connecting portions (42,52) preferably has a connecting wall (76,78) with curved ends that are tangent to associated engagement surfaces (38,48) in order to prevent stress concentration during use. In one embodiment of the wrench (10), the rotatable adjuster (56) is comprised by an adjusting nut (97) that receives an externally threaded portion (62) of the associated adjusting member (54) to provide the adjustment. In another embodiment of the wrench (10'), the rotatable adjuster (56) is comprised by an adjusting screw (110) that receives an internally threaded portion (106) of the associated adjusting member (54') to provide the adjustment. In each embodiment, the spacing between jaw ends (70 and 72) provides ease in switching from one wrench end to the other.

9 Claims, 2 Drawing Sheets

Fig. 1
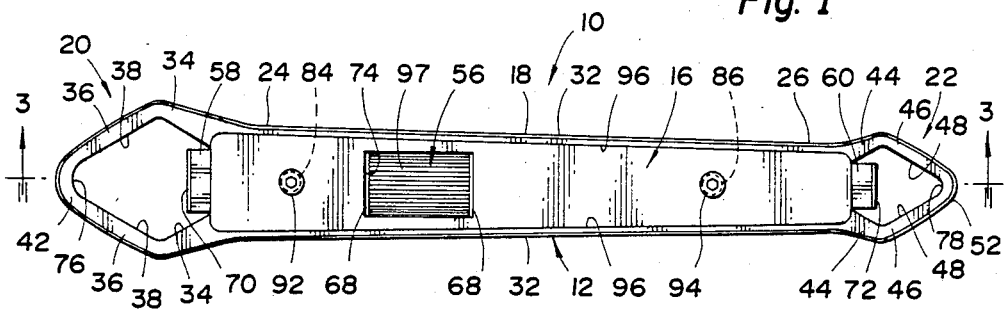
Fig. 2
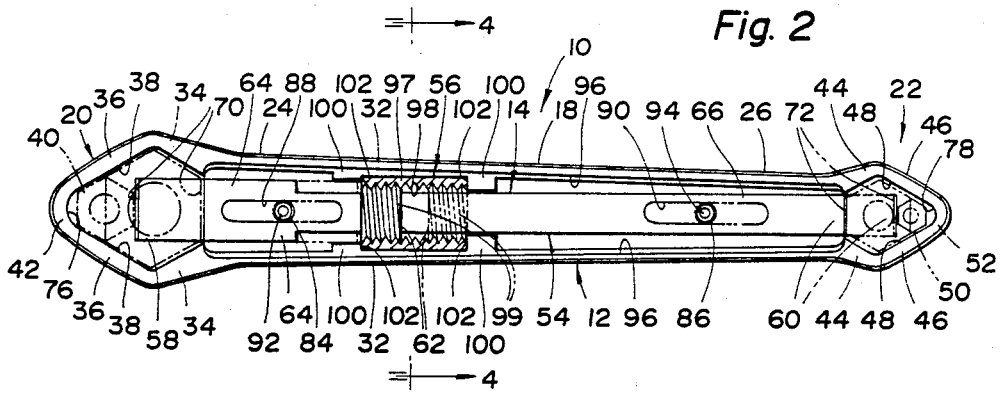
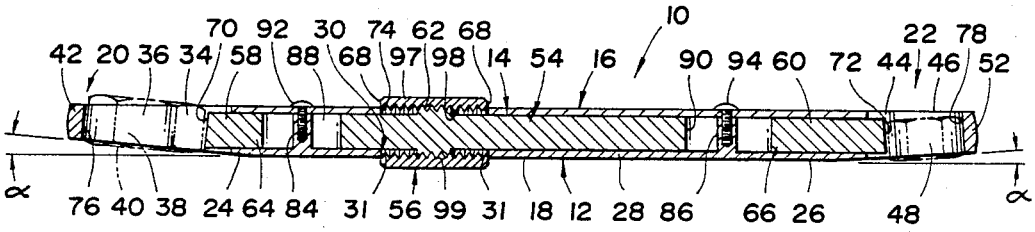
Fig. 3
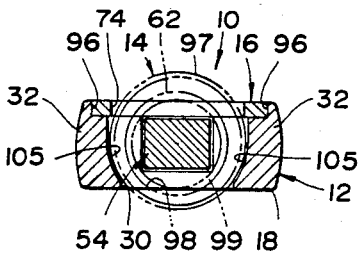
Fig. 4

ADJUSTABLE DOUBLE-ENDED BOX WRENCH

TECHNICAL FIELD

This invention relates to an improved adjustable double-ended box wrench.

BACKGROUND ART

Adjsutable wrenches have been used for many years to allow a single wrench to torque different size nuts and bolt heads without the need of a set of wrenches of different sizes. Most adjustable wrenches have previously been constructed with a handle end and a single open wrench end of an adjustable size such as disclosed by U.S. Pat. Nos. 1,561,812 While; 1,585,825 Bessolo; 1,781,994 Wilson, 2,814,226 Logczyc; 3,673,896 Vardaman; and 4,065,986 Meggs et al. Other adjustable wrenches have been of the double-ended open wrench type wherein the wrench has opposite ends that respectively support a pair of adjustable open end wrenches such as disclosed by U.S. Pat. Nos. 1,215,726 Skew and 1,444,907 Fisher.

Other adjustable wrenches have been of the double-ended box type to which the present invention relates. Such double-ended box wrenches have an elongated shape with a closed box wrench at each end such as disclosed by U.S. Pat. Nos. 592,199 Fletcher and 3,282,136 Maichen. In the Fletcher wrench, one of the adjustable box wrenches has a hexagonal shape of an adjustable size for torquing hexagonal nuts and bolts while the other box wrench has a square shape of an adjustable size for torquing square nuts and bolts. Adjustment is provided by rotation of a nut that is received by a threaded stem connected to movable jaws that are respectively associated with the hexagonal and square box wrenches. In the Maichen patent, both box wrenches are of a hexagonal shape with one having a greater size than the other. Adjustment of the Maichen wrench is provided by rotational adjustment of a disc that has diametrically opposite notches spaced at different distances so as to receive and appropriately position jaw members respectively associated with the large and small hexagonal box wrenches.

In addition to open end and closed box adjustable wrenches, the prior art also discloses combination open end and box end adjustable wrenches. Such combination adjustable wrenches have one end with an adjustable open end wrench and another end with an adjustable closed box wrench. Examples of such combination adjustable wrenches are disclosed by U.S. Pat. Nos. 4,151,763 and 4,325,275 of Colvin. Also, one embodiment of the previously mentioned U.S. Pat. No. 3,282,136 of Maichen also is of the adjustable combination type with an adjustable open wrench at one end and an adjustable closed box wrench at its other end.

In order to perform effectively, adjustable wrenches must have the capability of being adjustable to the required size without tolerance variations that permit a slight opening of the wrench upon the application of torque. Such a slight opening can cause the wrench to slip over the corners of the nut or bolt and thereby provide rounding that makes it increasingly difficult to subsequently apply torque. Also, to be effective, the end size of adjustable wrenches cannot be too large so as to prevent use thereof in confined spaces as is often necessary.

DISCLOSURE OF INVENTION

An object of the present invention is to provide an improved adjustable double-ended box wrench of a construction that is effective in performance, economical to manufacture, easy to assemble, capable of withstanding high torque, and easy to adjust to the required size for use.

In carrying out the above object and other objects of the invention, an adjustable double-ended box wrench constructed in accordance with the invention includes a wrench body, an adjustable jaw assembly supported by the wrench body, and a cover plate that retains the adjustable jaw assembly within the wrench body.

The wrench body of the adjustable double-ended box wrench has an elongated shape including a hollow intermediate portion, a large box wrench connected to one end of the intermediate portion, and a small box wrench connected to the other end of the intermediate portion of the wrench body. An investment casting operation, a sand casting operation or a forging operation is perferably utilized to manufacture the wrench body from a suitable metal such as steel which is then chrome plated or otherwise suitably finished.

The hollow intermediate portion of the wrench body has an elongated shape with opposite ends to which the large and small box wrenches are connected. This intermediate portion also has a base wall with an adjusting opening and also includes spaced side walls connected by the base wall and projecting therefrom in a spaced relationship to each other. A pair of adjusting seats of the intermediate portion of the wrench body are located between its side walls on opposite extremities of the adjusting opening toward the opposite ends of the intermediate portion.

At the one end of the intermediate portion of the wrench body, the large box wrench is connected and includes a pair of support portions extending therefrom in a diverging relationship to each other. A pair of engagement portions of the large box wrench extend from its support portions in a converging relationship to each other and have engagement surfaces that define an included angle of about 60° designed to provide torquing of hexagonal nuts or bolt heads. The large box wrench also includes a connecting portion that connects its engagement portions.

At the other end of the intermediate portion of the wrench body, the small box wrench is connected and includes a pair of support portions extending therefrom in a diverging relationship to each other. This small box wrench also includes a pair of engagement portions extending from its support portions in a converging relationship to each other and has engagement surfaces that define an included angle of about 60° designed to accommodate hexagonal nuts or bolt heads. This small box wrench also includes a connecting portion that connects its engagement portions.

The adjustable jaw assembly of the wrench as previously mentioned is supported by the wrench body and includes an elongated adjusting member, a rotatable adjuster that moves the adjusting member, and a pair of jaw ends that respectively provide gripping of a hexagonal nut or bolt.

Within the hollow intermediate portion of the wrench body, the elongated adjusting member is supported for movement along its length in opposite directions toward and away from the large and small box wrenches. This adjusting member has an intermediate portion including a threaded portion adjacent the adjusting opening in the base wall of the intermediate portion of the wrench body. End portions of the adjusting member extend in opposite directions from the threaded intermediate portion toward the large and small box wrenches.

The rotatable adjuster of the adjustable jaw assembly threadingly receives the threaded portion of the intermediate portion of the adjusting member and is located within the adjusting opening of the base wall of the wrench body. This rotatable adjuster has oppositely facing surfaces that engage the adjusting seats of the intermediate portion of the wrench body to move the adjusting member in opposite directions with respect to the large and small box wrenches upon rotation of the rotatable adjuster in opposite directions.

At the opposite ends of the end portions of the adjusting member, the pair of jaw ends are respectively received and movable between the support and engagement portion of the large and small box wrenches. Each jaw end includes a generally flat jaw surface that defines an angle of about 60° with respect to each of the pair of engagement surfaces of the associated box wrench to permit gripping of a hexagonal nut or bolt head thereby upon rotational adjustment of the rotatable adjuster.

The cover plate of the adjustable wrench extends between the side walls of the wrench body and is secured thereto to retain the adjustable jaw assembly within the hollow intermediate portion of the wrench body. This cover plate has an adjusting opening through which the rotatable adjuster projects to permit rotational adjustment from either side of the wrench to the appropriate size required.

In the preferred construction of the adjustable double-ended box wrench, the large and small box wrenches each has its connecting portions provided with a connecting wall having curved ends that are tangent to the associated adjustment surfaces to prevent stress concentration during use. In one embodiment, each connecting portion has its connecting wall ends provided with a curvature about a common center and the connecting wall most preferably has a continuously curved shape about that common center. In another embodiment, the connecting portion of each box wrench has its connecting wall ends provided with curvatures about different centers and most preferably has a generally flat wall portion extending between the curved ends. Also, each of the large and small box wrenches also preferably has the junctions between its support portions and engagement portions provided with curved shapes that reduce stress concentration during use.

In each embodiment disclosed, the hollow intermediate portion of the wrench body has its base wall provided with a pair of support posts between which its adjusting opening is located. Each of the spaced side walls projects from the base wall and has distal edges that define grooves facing each other. On opposite sides of the threaded portion of the elongated adjusting member, each end portion of the adjusting member has a slot that receives the adjacent support post of the intermediate portion of the wrench body to permit the adjusting movement thereof upon rotation of the rotatable adjuster. Upon assembly, the cover plate is received within the grooves of the side walls and extends therebetween with a pair of support posts to retain the adjustable jaw assembly within the hollow intermediate portion of the wrench body.

Convenience in use of the adjustable double-ended box wrench is provided by spacing the jaw ends of the adjustable jaw assembly such that the large box wrench has an adjusted size in the range of 80% to 120% of the adjusted size of the small box wrench when the small box wrench is adjusted to its maximum size. Most preferably, the jaw ends of the adjustable jaw assembly are spaced from each other such that the large box wrench has the same adjusted size as the small box wrench when the small box wrench is adjusted to its maximum size. As such, when the small box wrench is opened to its maximum size but is not quite large enough to receive the nut or bolt head to be torqued, the adjustable wrench is merely turned end for end to permit use of the large box wrench which is then just slightly further opened and utilized to provide the torquing.

In one preferred embodiment, the elongated adjusting member is provided with an intermediate portion having an externally threaded portion and the rotatable adjuster is embodied by an adjusting nut that threadingly receives the externally threaded portion of the intermediate portion of the adjusting member. Each adjusting seat of the hollow intermediate portion of the wrench body of this embodiment has a pair of seat surfaces that respectively extend inwardly from the pair of side walls and are engaged by oppositely facing surfaces of the adjusting nut such that rotation of the adjusting nut in opposite directions moves the adjusting member in opposite directions to thereby adjust the large and small box wrenches.

In the embodiment of the adjustable double-ended box wrench having the adjusting nut, the externally threaded intermediate portion of the adjusting member preferably has a greater size than the spacing between the cover plate and the base wall of the wrench body so as to be received within both openings. End surfaces of the openings of the cover plate and the base wall of the wrench body cooperate to engage the threaded intermediate portion of the adjusting member in order to limit movement of the adjusting member in opposite directions as the rotational adjustment of the adjusting nut takes place.

In one version of the invention, the elongated adjusting member of the adjustable jaw assembly has a unitary construction which has an externally threaded intermediate portion of a greater size than at least one of its end portions so as to permit insertion of that end portion through the associated adjusting nut for threading of the adjusting nut onto the externally threaded portion. In another version, the adjusting member of the adjustable jaw assembly has at least one end portion made separate from the threaded intermediate portion and preferably has both end portions thereof made separate from the threaded intermediate portion with a connection that secures each separate end portion to the threaded intermediate portion.

In another embodiment of the adjustable double-ended box wrench, the adjustable jaw assembly has its elongated adjusting member provided with an intermediate portion including an internally threaded portion. The rotatable adjuster of this embodiment is embodied by an adjusting screw that is threadingly received by the internally threaded portion of the intermediate portion of the adjusting member and the adjusting screw has oppositely facing surfaces that engage the adjusting seats of the intermediate portion of the wrench body.

Rotation of the adjusting screw in opposite directions moves the elongated adjusting member to provide adjustment of the jaw ends and consequent adjustment of the size of the large and small box wrenches.

In the preferred construction of the double-ended box wrench having the adjusting screw, the elongated adjusting member has a unitary construction. Also, the adjusting screw has end pins that project in opposite directions and are received between the cover plate and base wall to retain the adjusting screw on the wrench. The adjustable member of the jaw assembly has clearance notches as disclosed to receive the end pins of the screw in order to permit increased adjusting movement thereof upon rotational adjustment of the adjusting screw.

Each embodiment of the adjustable double-ended box wrench has the large and small box wrenches each provided with a slight inclination with respect to the intermediate portion of the wrench body to facilitate use of the wrench when torquing a nut or bolt head on a flat surface. Such inclination provides a spacing between the box wrench not being used so that the wrench can be held and manually torqued. Each of the pair of jaw ends of each box wrench has a slight inclination with respect to the elongated direction of the elongated adjusting member, and this slight inclination of the jaw ends is the same as the angular extent of the inclination of the box wrenched with respect to the intermediate portion of the wrench body such that the hexagonal nut or bolt head being torqued is engaged with surface-to-surface contact at three alternate faces.

The objects, features, and advantages of the present invention are readily apparent from the following detailed description of the best modes for carrying out the invention when taken in connection with the accompanying drawings.

BRIEF DESCRIPTION OF DRAWINGS

FIG. 1 is a plan view of an adjustable double-ended box wrench constructed in accordance with the present invention;

FIG. 2 is a plan view of the adjustable double-ended box wrench similar to FIG. 1 but with a cover plate thereof removed to illustrate the construction of an adjustable jaw assembly which has a rotatable adjuster embodied by an adjusting nut;

FIG. 3 is a longitudinal sectional view taken through the wrench along the direction of line 3—3 of FIG. 1 to further illustrate its construction;

FIG. 4 is a cross-sectional view taken through the wrench along the direction of line 4—4 in FIG. 2 to further illustrate the construction of the adjustable jaw assembly and a wrench body that mounts the jaw assembly;

BEST MODES FOR CARRYING OUT THE INVENTION

Figure 5:
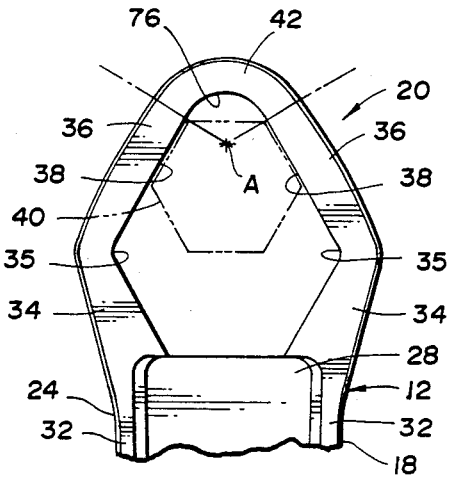
FIG. 5 is a partial plan view that illustrates one construction of a connecting portion that extends between engagement portions of the box wrench in a manner that reduces stress concentration during use.

With reference to FIGS. 1 through 3, an adjustable double-ended box wrench 10 is constructed in accordance with the present invention and includes a wrench body 12, and adjustable jaw assembly 14, and a cover plate 16. As is hereinafter more fully described, the cover plate 16 retains the adjustable jaw assembly 14 within the wrench body 12 to permit double ended adjustment of the box wrench 10.

As illustrated in FIGS. 1 through 4, the wrench body 12 is preferably made from metal as an investment casting, a sand casting, or a forging that is then finished by secondary operations. This wrench body 12 includes an elongated hollow intermediate portion 18, a large box wrench 20 connected to one end of the intermediate wrench portion 18, and a small box wrench 22 connected to the other end of the intermediate wrench portion 18. As is hereinafter more fully described, adjustment of the jaw assembly 14 adjusts the size of the large and small box wrenches 20 and 22 simultaneously with each other and thereby permits torquing of hexagonal nuts or bolt heads of different sizes.

As shown in FIGS. 2 through 4, the hollow intermediate portion 18 of the wrench body 12 has an elongated shape that tapers slightly in a direction from its end 24 to which the large box wrench 20 is connected toward its end 26 to which the small box wrench 22 is connected. Intermediate wrench portion 18 includes a base wall 28 having a generally rectangular adjusting opening 30 (FIG. 3) and also includes spaced side walls 32 that are connected by the base wall 28 and project therefrom to define a generally channel shape in which the adjustable jaw assembly 14 is received and retained by the cover plate 16. The intermediate portion 18 includes a pair of adjusting seats 31 located between the side walls 32 at opposite extremities of the adjusting opening 30.

As illustrating in FIGS. 1 through 3, the large box wrench 20 connected to the one end 24 of the intermediate portion 18 of wrench body 12 includes a pair of support portions 34 extending therefrom in a diverging relationship with respect to each other. The large box wrench 20 also includes a pair of engagement portions 36 extending from its support portions 34 in a converging relationship to each other. These engagement portions 36 have flat engagement surfaces 38 that define an included angle of about 60° so as to engage spaced faces of a hexagonal nut or bolt head 40. A connecting portion 42 of the large box wrench connects its engagement portions 36 to define a generally enclosed shape that defines the box wrench in cooperation with the adjustable jaw assembly 14.

As also illustrated best in FIGS. 1 through 3, the small box wrench 22 is connected to the other end 26 of the intermediate portion 18 of wrench body 12 and includes a pair of support portions 44 extending therefrom in a diverging relationship with respect to each other. The small box wrench 22 also includes a pair of engagement portions 46 extending from its support portions 44 in a converging relationship to each other and having flat engagement surfaces 48 that define an included angle of about 60° so as to engage spaced faces of a hexagonal nut or bolt head 50. A connecting portion 52 of the small box wrench 22 connects its engagement portions 46 so as to define an enclosed shape that cooperates with the adjustable jaw assembly 14 in providing the small box wrench engagement of alternate faces of the nut or bolt head 50 during torquing.

As illustrated in FIGS. 2 through 4, the adjustable jaw assembly 14 includes an elongated adjusting member 54, a rotatable adjuster 56, and a pair of jaw ends 58 and 60 respectively associated with the large and small box wrenches 20 and 22. As is hereinafter more fully described, rotation of the adjuster 56 in opposite directions moves the adjusting member 54 in opposite directions to simultaneously position the location of the jaw ends 58 and 60 to thus adjust the size of both the large and small box wrenches 20 and 22.

With continued reference to FIGS. 2 through 4, the elongated adjusting member 54 is supported within the hollow intermediate portion 18 of the wrench body 12 for movement along the length thereof in opposite directions toward and away from the large and small box wrenches 20 and 22. Adjusting member 54 has an intermediate portion including a threaded portion 62 that is located adjacent the adjusting opening 30 in the base wall 28 of the intermediate portion 18 of the wrench body 12. Adjusting member 54 also has end portions 64 and 66 that extend in opposite directions from the threaded intermediate portion 62 respectively toward the large and small box wrenches 20 and 22.

With reference to FIGS. 2 through 4, the rotatable adjuster 56 threadingly receives the threaded portion 62 of the intermediate portion of the adjusting member and is located within the adjusting opening 30 in the base wall 28 of the wrench body 12. The rotatable adjuster 56 has oppositely facing surfaces 68 that engage the adjusting seats 31 of the intermediate portion 18 of wrench body 12 so as to be positioned against axial movement upon rotational adjustment. Thus, rotation of the rotatable adjuster 56 in opposite directions through its engagement with the threaded portion 62 of the adjusting member 54 provides movement of the adjusting member in opposite directions with respect to the large and small box wrenches 20 and 22 in order to simultaneously adjust the size of each box wrench, with the large box wrench becoming smaller as the small box wrench becomes larger, and with the large box wrench becoming larger as the small box wrench becomes smaller.

Figure 7:
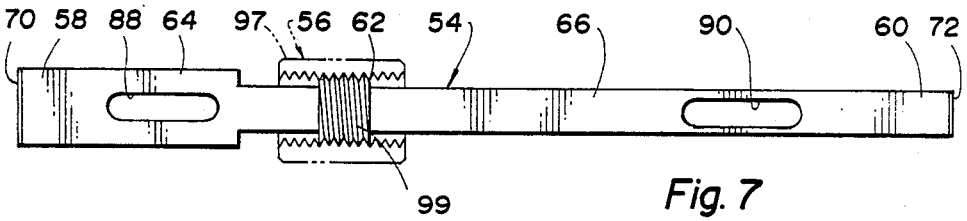
FIG. 7 is a plan view of an elongated adjusting member of a unitary construction that includes a pair of jaw ends whose movement adjusts the size of the associated box wrench during use.

As shown by combined reference to FIGS. 2, 3, and 7, the pair of jaw ends 58 and 60 on the opposite ends of end portion 64 and 66 are respectively received and movable between the support and engagement portions 34,36 and 44,46 of the large and small box wrenches 20 and 22 respectively. The jaw ends 58 and 60 include associated flat jaw surfaces 70 and 72 that each define an angle of about 60° with respect to each of the pair of engagement surfaces 38 and 48 of the associated box wrench. This angular relationship of the jaw end surfaces 70 and 72 with respect to the engagement surfaces 38 and 48 and the angular relationship between the engagement surfaces permits gripping of hexagonal nuts or bolt heads 40 and 50 at alternate faces as illustrated, and appropriate rotational adjustment of the rotatable adjuster 56 provides the proper sizing for whichever size wrench is required.

As illustrated in FIG. 1, the cover plate 16 has a slightly tapered shape extending from the large box wrench 20 toward the small box wrench 22 and extends between the side walls 32 of the wrench body 12 with securement being provided thereto as is hereinafter more fully described to retain the adjustable jaw assembly 14 within the hollow intermediate portion 18 of the wrench body. This cover plate 16 has an adjusting opening 74 through which the rotatable adjuster 56 projects to permit rotational adjustment from either side of the wrench as best shown in FIG. 3.

Figure 6:
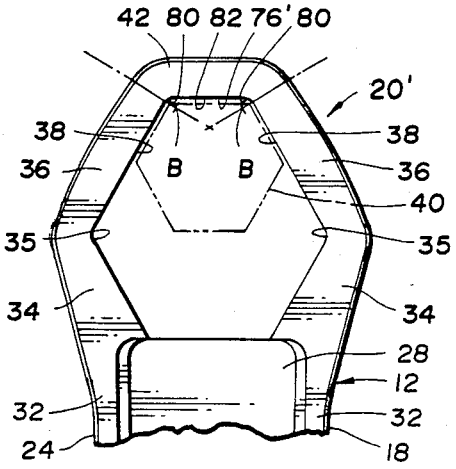
FIG. 6 is a partial plan view of another embodiment of a connecting portion that extends between engagement portions of the box wrench in a manner that reduces stress concentration during use.

As best illustrated in FIGS. 1 and 2, the connecting portions 42 and 52 of the large end small box wrenches 20 and 22 have connecting walls 76 and 78 with curved ends that are tangent to the associated engagement surfaces 38 and 48 to thereby prevent stress concentration during use and thus enable the adjustable wrench to transmit a greater torque than would otherwise be possible. Each box wrench 20 and 22 also has curved wall portions 35 and 45, respectively, connecting its support and engagement portions 34,36 and 44,46 to reduce stress concentration during use. As illustrated in FIG. 5, the large box wrench 20, which is also illustrative of the small box wrench 22 shown in FIGS. 1 through 3, has its connecting wall 76 provided with a curvature about a common center A such that a partially circular arc is defined by the connecting wall 76 between the two engagement walls 38. As illustrated in FIG. 6, a modified version of the large box wrench 20' which would also be illustrative of the associated small box wrench has its connecting wall 76' provided with wall ends 80 having curvatures about different centers B. As illustrated, a generally flat wall portion 82 preferably extends between the curved ends 80 to cooperatively define the connecting wall 76' that connects the associated engagement surfaces 38 for engaging the nut or bolt head 40.

As shown in FIGS. 2 and 3, the wrench 10 as disclosed has its base wall 28 provided with a pair of support posts 84 and 86 that project upwardly between the side walls 32 respectively adjacent the large and small box wrenches 20 and 22. The adjusting opening 30 of the base wall 28 is located between the supports posts 84 and 86 to receive the rotatable adjuster 56 as previously described. End portions 64 and 66 of the adjusting member 54 have associated slots 88 and 90 that respectively receive the support posts 84 and 86 to permit the adjusting member movement as previously described upon rotation of the rotatable adjuster 56. A pair of fasteners provided by threaded screws 92 and 94 connect the cover plate 16 to the support posts 84 and 86 to thereby retain the adjustable jaw assembly 14 within the hollow intermediate portion of wrench body 12. Distal ends of the side walls 32 define grooves 96 that face toward each other as shown in FIG. 4 and receive the edges of the cover plate 16 so as to thereby cooperate with the fasteners 92 and 94 in retaining the cover plate. As shown in FIG. 3, the ends of the support posts 84 and 86 engage the cover plate 16 and thus cooperate with the grooves 96 shown in FIG. 4 to space the cover plate from the base wall 28 so as to permit the jaw assembly to be movably adjusted as previously described.

As shown in FIGS. 2 and 3, the jaw ends 70 and 72 of the adjusting member 54 are spaced from each other such that the large box wrench 20 has an adjusted size in the range of 80% to 120% of the adjusted size of the small box wrench the small box wrench is adjusted to its maximum size as shown by solid line representation in FIG. 2. Such a size relationship facilitates switching from one end of the wrench to the other when the nut or bolt head being torqued has a size approximately equal to the minimum size of the large box wrench 20 and to the maximum size of the small box wrench 22. Most preferably, the jaw ends 70 and 72 are spaced from each other such that the large box wrench 20 has the same adjusted size as the small box wrench 22 when the small box wrench is adjusted to its maximum size. More specifically, the large box wrench 20 illustrated is sized to receive hexagonal nuts or bolt heads of a nominal 9/16 inch to $\frac{7}{8}$ inch size while the small box wrench 22 is sized to receive nuts or bolt heads of a nominal $\frac{1}{4}$ inch to 9/16 inch size.

In the embodiment of the wrench 10 shown in FIGS. 1 through 3, the rotatable adjuster 56 comprises an adjusting nut 97 having internal threads 98 and the threaded portion 62 of the adjusting member 54 is externally threaded with external threads 99 that threadingly receive the adjusting nut. At the opposite ends of the adjusting nut 97, the intermediate portion 18 of wrench body 12 includes lugs 100 (FIG. 2) that project inwardly from the side walls 32 and define seat surfaces 102 for engaging the oppositely facing end surfaces 68 of adjusting nut 97 to provide the axial positioning thereof that positions the adjusting nut during rotation so as to provide the movement of the adjusting member 54. It should also be mentioned that the adjusting nut 97 projects outwardly through both the adjusting opening 30 of the wrench body base wall 28 and through the adjusting opening 74 of the cover plate 16 and has its oppositely facing end surfaces 68 engaged with the end surfaces of these openings to further position the adjusting nut in cooperation with the seat surfaces 102 that cooperatively provide the adjusting seats 31. Also, as shown in FIG. 4, the wrench body 12 has arcuate seat surfaces 105 that engage the round circumference of adjusting nut 97 to provide lateral positioning thereof, and the round circumference of the adjusting nut has a grooved or knurled texture to facilitate the manually actuated rotation for adjustment of the wrench.

As best illustrated in FIG. 3, the externally threaded intermediate portion 62 of the adjusting member 54 preferably has a greater size than the spacing between the base wall 28 of the wrench body and the cover plate 16. This size relationship permits the externally threaded portion 62 to be located within both of the adjusting openings 30 and 74 so as to engage the end surfaces thereof as shown by solid and phantom line representation, with the solid line representation illustrating the minimum size of the small box wrench 22, and with the phantom line representation illustrating the maximum size of the large box wrench 20 and the minimum size of the small box wrench 22.

The adjusting member 54 illustrated in FIGS. 2 and 3 and further illustrated in FIG. 7 has a unitary construction that can be made in any suitable manner such as by casting, a screw machine operation or by a powered metal forming operation and any necessary secondary finishing operations. With this unitary construction, the end portion 66 associated with the small box wrench has a sufficiently small size along its entire length so as to be insertable into the associated adjusting nut 97 to provide the threaded engagement with the externally threaded portion 62.

Figure 8:
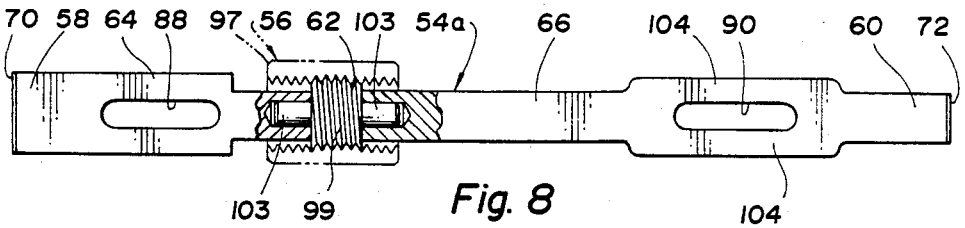
FIG. 8 is a view of another embodiment of the elongated adjusting member which has a multiple piece construction wherein the end portions project from an intermediate threaded portion and have associated connections thereof.

As illustrated in FIG. 8, another version of the adjusting member **54*a* has the end portion 66 associated with the small box wrench made separate from the threaded intermediate portion 62 and has a press fit pin connection 103 for providing securement therebetween upon assembly. Prior to the completion of the connection 103, the adjusting nut 97 is threaded onto the externally threaded intermediate portion 62 as illustrated by phantom line representation. This multiple piece construction of the adjusting member 54*a* allows the legs 104 adjacent the associated slot 90 to have a greater size and hence a greater strength than is possible with the unitary version illustrated in FIG. 7. However, it should be mentioned that the loading of the end portion 66 associated with the small box wrench like the loading of the end portion 64 associated with the large box wrench is in compression and that the unitary construction illustrated despite the smaller size of the legs adjacent the slot 90** is sufficiently strong to carry torque levels for which the wrench is designed.

With continuing reference to FIG. 8, it should also be noted that the adjusting member **54*a* has its end portion 64 associated with the large box wrench also made separate from the threaded intermediate portion 62 and has a press fitted pin connection 103 in the same manner as the press fit connection previously described. This three piece construction of the adjusting member 54*a* permits both end portions 64 and 66 to be conveniently made by blanking or by a powered metal forming operation while the threaded intermediate portion 62 is conveniently made by a screw machine operation. Also, the connection 103** may be threaded instead of press fitted.

Figure 9:
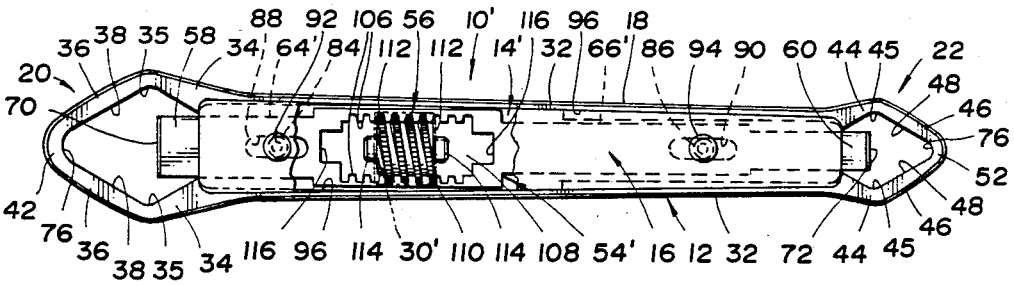
FIG. 9 is a plan view of another embodiment of the adjustable double-ended box wrench wherein the cover plate is partially broken away to illustrate its adjustable jaw assembly which includes a rotatable adjuster embodied by an adjusting screw and which also includes an internally threaded portion on its elongated adjusting member.

With reference to FIG. 9, another embodiment 10' of an adjustable double-ended box wrench according to the present invention has generally the same construction as the previously described embodiment except as will be noted such that like reference numerals are applied to like components thereof and the foregoing description is also applicable and need not be repeated. This modified embodiment of the adjustable double-ended box wrench 10' has its adjustable jaw assembly 14' provided with an adjusting member 54' whose intermediate portion includes an internally threaded portion 106 adjacent the adjusting opening 30' in the base wall 28 of the intermediate portion 18 of wrench body 12. More specifically, the end portions 64' and 66' of the adjusting member 54' project in opposite directions from an intermediate opening 108 whose opposite sides are threaded to provide the threaded portion 106. The rotatable adjuster 56 of this version of the wrench is embodied by an adjusting screw 110 located within the adjusting opening 30' on the base wall 28 of the wrench body 12. Adjusting screw 110 has oppositely facing surfaces 112 that engage the adjusting seats 31 provided by the ends of the adjusting openings in both the base wall and the associated cover plate in the same manner previously described in connection with the embodiment shown in FIGS. 1 through 4.

With continuing reference to FIG. 9, the adjustable double-ended wrench 10' preferably has its adjusting member 54' provided with a unitary construction to facilitate its manufacturing by blanking or powered metal forming. Furthermore, the adjusting screw 110 has end pins 114 that project in opposite directions and are received between the associated cover plate and wrench body base wall to thereby retain the adjusting screw on the wrench. Also, the opening 108 in adjusting member 54' has clearance notches 116 that receive the end pins 114 of the adjusting screw 110 to permit increased adjusting movement thereof upon rotation of the adjusting screw.

As also illustrated in FIG. 3, each embodiment of the adjustable double-ended box wrench preferably has its large and small box wrenches 20 and 22 provided with a slight inclination as illustrated by angle $\alpha$ to facilitate use of the wrench in torquing of nuts and bolt heads located along a flat surface or in alignment with another object. Also, the pair of jaw end surfaces 70 and 72 of each box wrench likewise has a slight inclination with respect to the elongated direction of the elongated adjusting member thereof, and this inclination is of the same angular extent as the inclination of the associated box wrenches 20 and 22 with respect to the intermediate portion of the wrench body. As such, the jaw end surfaces 70 and 72 are capable of engaging an associated nut or bolt head in cooperation with the associated engagement surfaces 38 or 48 with surface-to-surface contact at alternate faces as previously described.

While the best modes for describing the invention have been described in detail, those familiar with the art to which this invention relates will recognize various alternative designs and embodiments for practicing the invention as defined by the following claims.

What is claimed is:

1. An adjustable double-ended box wrench comprising:

(A) a wrench body of an elongated shape including:

(a) a hollow intermediate portion of an elongated shape having opposite ends, said intermediate portion including a base wall having an adjusting opening and also including a pair of spaced side walls connected by the base wall and projecting therefrom, and said intermediate portion having a pair of adjusting seats located between the side walls on opposite extremities of the adjusting opening toward the opposite ends of the intermediate portion;

(b) a large box wrench connected to one end of the intermediate portion of the wrench body and including support portions extending therefrom in a diverging relationship to each other, said large box wrench also including engagement portions extending from its support portions in a converging relationship to each other and having engagement surfaces that define an included angle of about 60°, and said large box wrench also including a connecting portion; and (c) a small box wrench connected to the other end of the intermediate portion of the wrench body and including support portions extending therefrom in a diverging relationship to each other, said small box wrench also including engagement portions extending from its support portions in a converging relationship to each other and having engagement surfaces that define an included angle of about 60°, and said small box wrench also including a connecting portion that connects its engagement portions;

(B) an adjustable jaw assembly supported by the wrench body and including:

(a) an elongated adjusting member supported within the hollow intermediate portion of the wrench body for movement along the length thereof in opposite directions toward and away from the large and small box wrenches, said adjusting member having an intermediate portion including an externally threaded portion adjacent the adjusting opening in the base wall of the intermediate portion of the wrench body, and said adjusting member having end portions that extend in opposite directions from the threaded intermediate portion toward the large and small box wrenches;

(b) an adjusting nut that threadingly receives the externally threaded portion of the intermediate portion of the adjusting member, said adjusting nut being located within the adjusting opening of the base wall of the wrench body, and the adjusting nut having oppositely facing surfaces that engage the adjusting seats of the intermediate portion of the wrench body to move the adjusting member in opposite directions with respect to the large and small box wrenches upon rotation of the adjusting nut in opposite directions; and (c) a pair of jaw ends on the opposite ends of the end portions of the adjusting member, said pair of jaw ends being respectively received between the support and engagement portions of the large and small box wrenches, and each jaw end including a generally flat jaw surface that defines an angle of about 60° with respect to each of the pair of engagement surfaces of the associated box wrench to permit gripping of a hexagonal nut or bolt head thereby upon appropriate rotational adjustment of the adjusting nut; and (C) a cover plate that extends between the side walls of the wrench body and is secured thereto to retain the adjustable jaw assembly within the hollow intermediate portion of the wrench body, said cover plate having an adjusting opening through which the adjusting nut projects to permit the rotational adjustment from either side of the wrench, the externally threaded intermediate portion of the adjusting member having a greater size than the spacing between the cover plate and the base wall of the wrench body so as to be received within the openings thereof, and the openings of the cover plate and base wall of the wrench body having end surfaces that engage the threaded intermediate portion of the adjusting member in order to limit movement of the adjusting member in opposite directions.

2. An adjustable double-ended box wrench as in claim 1 wherein the elongated adjusting member has a unitary construction.

3. An adjustable double-ended box wrench as in claim 1 wherein the elongated adjusting member has at least one end portion thereof made separate from the threaded intermediate potion, and a connection that secures the externally threaded intermediate portion of the adjusting member to said one separate end portion.

4. An adjustable double-ended box wrench as in claim 1 wherein the elongated adjusting member has both end portions thereof made separate from the threaded intermediate portion, and connections that secure the threaded intermediate portion of the adjusting member to the separate end portions.

5. An adjustable double-ended box wrench comprising:

(A) a wrench body of an elongated shape including:

(a) a hollow intermediate portion of an elongated shape having opposite ends, said intermediate portion including a base wall having an adjusting opening and also including spaced side walls connected by the base wall and projecting therefrom, and said intermediate portion having a pair of adjusting seats located between the side walls on opposite extremities of the adjusting opening toward the opposite ends of the intermediate portion;

(b) a large box wrench connected to one end of the intermediate portion of the wrench body and including support portions extending therefrom in a diverging relationship to each other, said large box wrench also including engagement portions extending from its support portions in a converging relationship to each other and having engagement surfaces that define an included angle of about 60°, and said large box wrench also including a connecting portion that connects its engagement portions; and (c) a small box wrench connected to the other end of the intermediate portion of the wrench body and including support portions extending therefrom in a diverging relationship to each other, said small box wrench also including engagement portions extending from its support portions in a converging relationship to each other and having engagement surfaces that define an included angle of about 60°, and said small box wrench also including a connecting portion that connects its engagement portions;

(B) an adjustable jaw assembly supported by the wrench body and including:

(a) an elongated adjusting member supported within the hollow intermediate portion of the wrench body for movement along the length thereof in opposite directions toward and away from the large and small box wrenches, said adjusting member having an intermediate portion including an internally threaded portion adjacent the adjusting opening in the base wall of the intermediate portion of the wrench body, and said adjusting member having end portions that extend in opposite directions from the internally threaded intermediate portion toward the large and small box wrenches;

(b) an adjusting screw that is threadingly received by the internally threaded portion of the intermediate portion of the adjusting member, said adjusting screw being located within the adjusting opening of the base wall of the wrench body, the adjusting screw having oppositely facing surfaces that engage the adjusting seats of the intermediate portion of the wrench body to move the adjusting member in opposite directions with respect to the large and small box wrenches upon rotation of the adjusting screw in opposite directions, and said adjusting screw having end pins that project in opposite directions toward the large and small box wrenches; and (c) a pair of jaw ends on the opposite ends of the end portions of the adjusting member, said pair of jaw ends being respectively received between the support and engagement portions of the large and small box wrenches, and each jaw end including a generally flat jaw surface that defines an angle of about 60° with respect to each of the pair of engagement surfaces of the associated box wrench to permit gripping of a hexagonal nut or bolt head thereby upon appropriate rotational adjustment of the adjusting screw; and (C) a cover plate that extends between the side walls of the wrench body and is secured thereto to retain the adjustable jaw assembly within the hollow intermediate portion of the wrench body, said cover plate having an adjusting opening through which the adjusting screw projects to permit the rotational adjustment from either side of the wrench, and the end pins of the adjusting screw being received between the cover plate and the base wall of the wrench body to retain the adjusting screw on the wrench.

6. An adjustable double-ended box wrench as in claim 5 wherein the elongated adjusting member has a unitary construction.

7. An adjustable double-ended box wrench as in claim 5 or 6 wherein the adjusting screw has end pins that project in opposite directions and are received between the cover plate and base wall to retain the adjusting screw on the wrench.

8. An adjustable double-ended box wrench as in claim 7 wherein the adjustable member has clearance notches that receive the end pins of the screw to permit increased adjusting movement thereof upon rotation of the adjusting screw.

9. An adjustable double-ended box wrench as in claim 1 or 5 wherein the large and small box wrenches each has a slight inclination with respect to the intermediate portion of the wrench body to facilitate use of the wrench, and the pair of jaw ends of each box wrench having a slight inclination with respect to the elongated direction of the elongated adjusting member and of the same angular extent as the inclination of the associated box wrench with respect to the intermediate portion of the wrench body.

* * * * *

UNITED STATES PATENT AND TRADEMARK OFFICE

CERTIFICATE OF CORRECTION

PATENT NO. : 4,787,275

DATED : November 29, 1988

INVENTOR(S) : David S. Colvin

It is certified that error appears in the above-identified patent and that said Letters Patent is hereby corrected as shown below:

Column 1, Line 10 "Adjsutable" should be --adjustable--;

Column 1, Line 16 "While" should be --White--;

Column 3, Line 20 "portion" should be --portions--;

Column 6, Line 19 "double ended" should be --double-ended--;

Column 6, Line 50 "illustrating" should be --illustrated--;

Column 8, Line 46 "supports" should be --support--;

Column 9, Line 2 after "small box wrench" (first occurence), insert --when--;

Column 10, Line 52 after "30'", "on" should be --of--;

UNITED STATES PATENT AND TRADEMARK OFFICE

CERTIFICATE OF CORRECTION

PATENT NO. : 4,787,275

DATED : November 29, 1988

INVENTOR(S) : David S. Colvin

It is certified that error appears in the above-identified patent and that said Letters Patent is hereby corrected as shown below:

Column 12, Line 54, Claim 3 "potion" should be --portion--.

Signed and Sealed this

Thirteenth Day of June, 1989

*Attest:*

DONALD J. QUIGG

*Attesting Officer*

*Commissioner of Patents and Trademarks*